US006311497B1

(12) United States Patent
Chung

(10) Patent No.: US 6,311,497 B1
(45) Date of Patent: Nov. 6, 2001

(54) DEVICE FOR COLD AND WARM FORMENTATIONS

(76) Inventor: Young-Chun Chung, 6F, Shindong Bldg., 298 Deaheung-Dong, Mapo-Gu Seoul (KR)

( * ) Notice: Subject to any disclaimer, the term of this patent is extended or adjusted under 35 U.S.C. 154(b) by 0 days.

(21) Appl. No.: 09/532,547

(22) Filed: Mar. 22, 2000

(51) Int. Cl.[7] ..... F25B 21/02

(52) U.S. Cl. ..... 62/3.3; 62/3.5; 62/3.7; 62/259.3

(58) Field of Search ..... 62/3.3, 3.5, 3.7, 62/259.3

(56) References Cited

U.S. PATENT DOCUMENTS

| | | | | |
|---|---|---|---|---|
| 3,132,688 | * | 5/1964 | Nowak | 62/3.5 |
| 3,648,469 | * | 3/1972 | Chapman | 62/3 |
| 4,470,263 | * | 9/1984 | Lehovec et al. | 62/3 |
| 4,930,317 | * | 6/1990 | klein | 62/3.3 |
| 5,802,865 | * | 9/1998 | Strauss | 62/259.3 |
| 5,806,335 | * | 9/1998 | Herbert et al. | 62/434 |
| 5,964,092 | * | 10/1999 | Tozuka et al. | 62/3.7 |
| 5,970,718 | * | 10/1999 | Arnold | 62/3.5 |
| 6,023,932 | * | 2/2000 | Johnston | 62/3.5 |
| 6,125,636 | * | 10/2000 | Taylor et al. | 62/3.5 |

* cited by examiner

*Primary Examiner*—William Doerrler
*Assistant Examiner*—Mark Shulman
(74) *Attorney, Agent, or Firm*—McCormick, Paulding & Huber LLP

(57) ABSTRACT

A device for cold and warm fomentations is disclosed. The device has a fomentation head and a heat exchange element control unit. The fomentation head includes a semiconductor heat exchange element. A coolant tank is mounted on the top surface of the heat exchange element. A heat conducting plate is fixed to the bottom surface of the heat exchange element. A far infrared radiation ceramic or metal-coated layer is positioned on the bottom surface of the heat conducting plate. The heat exchange element control unit includes a direct current electric source. A power polarity converting switch circuit is connected to the heat exchange element in parallel with the electric source. A program circuit is connected to the power polarity converting switch circuit at its output terminal. A rush current restricting element is connected to the heat exchange element. A power on-off relay switch is connected to the program circuit at its input terminal and to the power polarity converting switch circuit and the rush current restricting element. A first control circuit and a second control circuit are connected to the heat exchange element at their input terminals and to the power on-off relay switch at their output terminals.

3 Claims, 4 Drawing Sheets

DEVICE FOR COLD AND WARM FORMENTATIONS

BACKGROUND OF THE INVENTION

1. Field of the Invention

The present invention relates, in general, to fomenting devices and, more particularly, to a device for cold and warm fomentations, performing a cold fomentation as well as a warm fomentation, being capable of controlling the temperature of a fomentation head over a wide range, being inexpensively manufactured and being of a small size.

2. Description of the Prior Art

As well known to those skilled in the art, for a cold or warm fomentation, there is performed a fomenting method wherein a wet towel is applied to the superficial parts of the body after a towel is wet with chilled water or hot water. However, this method causes excessive inconvenience to a practitioner.

On the other hand, there is proposed a fomenting device wherein heat is generated by means of a metal heater, a pyrogen or a far infrared radiation heater, and the generated heat is applied to the superficial parts of the body However, this device may not be used for a cold fomentation, but may be used for a warm fomentation because the device generates only heat.

SUMMARY OF THE INVENTION

Accordingly, the present invention has been made keeping in mind the above problems occurring in the prior art, and an object of the present invention is to provide a device for cold and warm fomentations, performing a cold fomentation as well as a warm fomentation, being capable of controlling the temperature of a fomentation head over a wide range, being inexpensively manufactured and being of a small size.

In order to accomplish the above object, the present invention provides a device for cold and warm fomentations, comprising: a fomentation head consisting of a semiconductor heat exchange element, a coolant tank mounted on the top surface of the heat exchange element, a heat conducting plate fixed to the bottom surface of the heat exchange element, and a far infrared radiation ceramic or metal-coated layer positioned on the bottom surface of the heat conducting plate; and a heat exchange element control unit consisting of a direct current electric source supplying electric power to the heat exchange element, a power polarity converting switch circuit connected to the heat exchange element in parallel with the electric source, a program circuit connected to the power polarity converting switch circuit at its output terminal, the program circuit outputting control program signals which manually or automatically convert a polarity of the electric power according to predetermined time intervals, a rush current restricting element connected to the heat exchange element, a power on-off relay switch connected to the program circuit at its input terminal and connected to the power polarity converting switch circuit and the rush current restricting element, and a first control circuit and a second control circuit connected to the heat exchange element at their input terminals and to the power on-off relay switch at their output terminals, the first control circuit outputting a switching signal at a predetermined maximum plus degree temperature, while the second control circuit outputs a switching signal at a predetermined maximum, minus degree temperature.

BRIEF DESCRIPTION OF THE DRAWINGS

The above and other objects, features and other advantages of the, present, invention will be more clearly understood from the following detailed description taken in conjunction with the accompanying drawings, in which.

DESCRIPTION OF THE PREFERRED EMBODIMENTS

Figure 1:
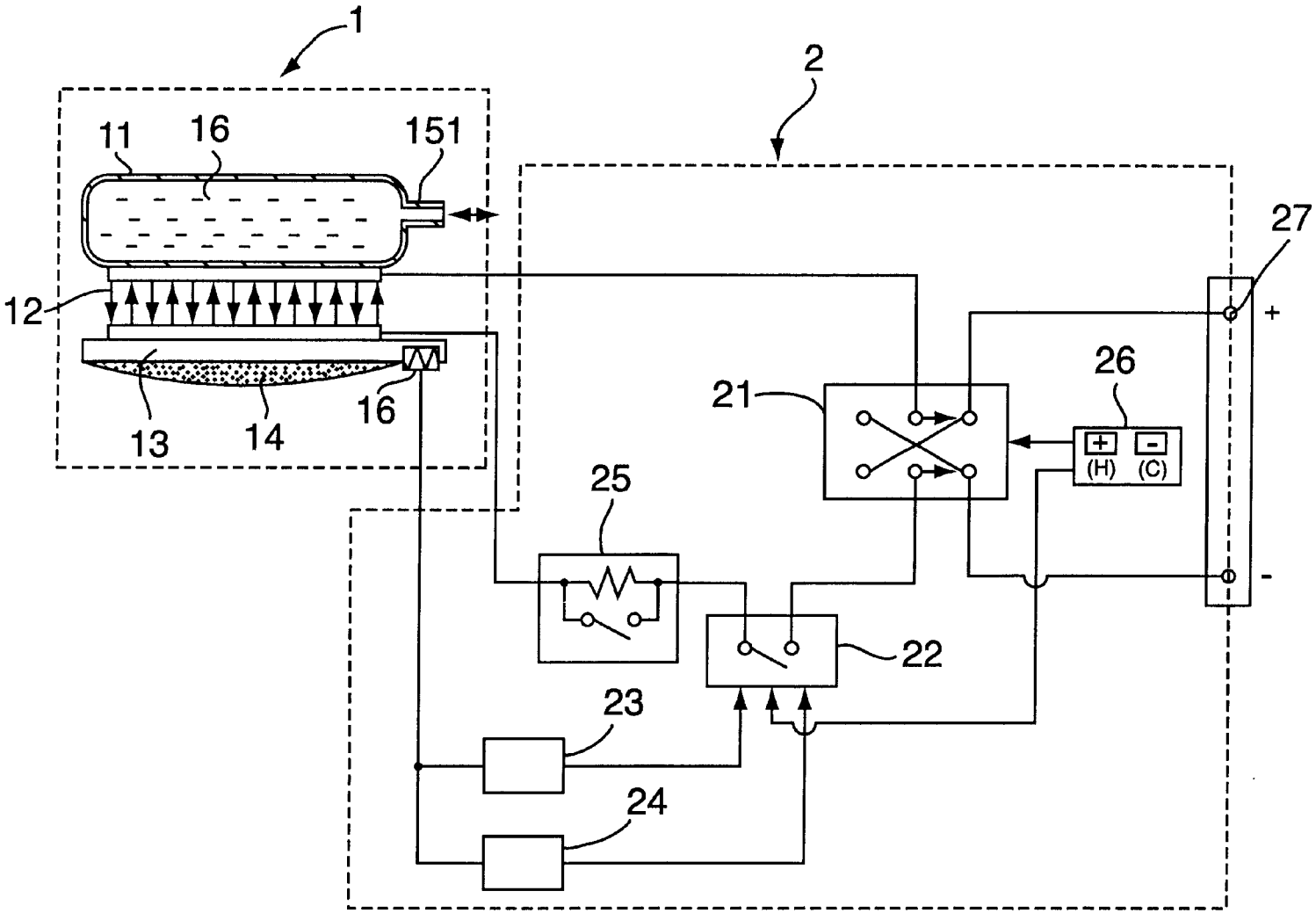
FIG. 1 is a circuit diagram of a device for cold and warm fomentations according to a preferred embodiment of this invention.

In FIG. 1, there is illustrated a circuit diagram of a device for cold and warm fomentations according to a preferred embodiment of this invention. The device for cold and warm fomentations generally consists of a fomentation head land a heat exchange element control unit 2.

First of all, the fomentation head 1 is described hereinafter.

The fomentation head 1 includes a known semiconductor heat exchange element 12 in its interior A coolant tank 11, made of metal that is highly heat-conductive, is mounted on the top surface of the heat exchange element 12. A heat conducting plate 13 is fixed to the bottom surface of the heat exchange element 12. Far infrared radiation ceramic or metal is coated on the bottom surface of the heat conducting plate 13, thus forming a far infrared radiation ceramic or metal-coated layer 14. A temperature sensor 16 consisting of a thermistor or a semiconductor temperature sensor is mounted at the surface of the heat conducting plate 13.

On the other hand, the coolant tank 11 is filled with coolant 15. In order to circulate the coolant, a coolant circulating circuit is constructed by connecting a coolant circulating tube 151 to the coolant tank 11 and interposing a pump 28 and a heat exchange tank 29 at certain portions of the coolant circulating tube 151. The length of the coolant circulating tube 151 is preferred to be sufficient so as to allow the fomentation head 1 to be freely handled.

Referring to FIG. 1, the heat exchange element control unit 2 is described in the following.

A direct current electric source of 10–15V supplies electric power to the heat exchange element 12. When the polarity of the power is converted, the polarity of the heat exchange of the semiconductor heat exchange element 12 is converted, too.

A power polarity converting switch circuit 21 is connected to the heat exchange element 12 in parallel with the electric source. The power polarity converting switch-circuit 21 is connected to a program circuit 26 at its input terminals and the electric source. The program circuit 26 outputs control program signals that manually or automatically convert the polarity of the electric power according to predetermined time intervals.

On the other hand, a rush current restricting element 25 is connected to the heat exchange element 12, the rush current restricting element 25 consisting of a resistor or a NTC (Negative Temperature Coefficient) thermistor. The rush current restricting element 25 is connected to a power on-off relay switch 22. The power on-off relay switch 22 is connected to the program circuit 26 at its input terminal so as to be controlled by the program circuit 26. The temperature sensor 16 is connected to a first control circuit 23 and a second control circuit 24 at its output terminal, the first control circuit 23 outputting a switching signal at a predetermined maximum plus degree temperature, while the second control circuit 24 outputs a switching signal at a predetermined maximum minus degree temperature. The first and second control circuits 23 and 24 are connected to the power on-off relay switch 22 at their output terminals, respectively.

As described above, the program circuit 26 of the heat exchange element control unit 2 outputs a "HOT signal (a plus value)", an "OFF signal (a zero value)" or a "COLD signal (a minus value)". In response to such a signal, the power polarity converting switch 21 converts the polarity of the supplied electric power or the power on-off relay switch 22 interrupts power input into the semiconductor heat exchange element 12, thereby allowing the bottom surface of the fomentation head 2 to become cold or warm.

Figure 5:
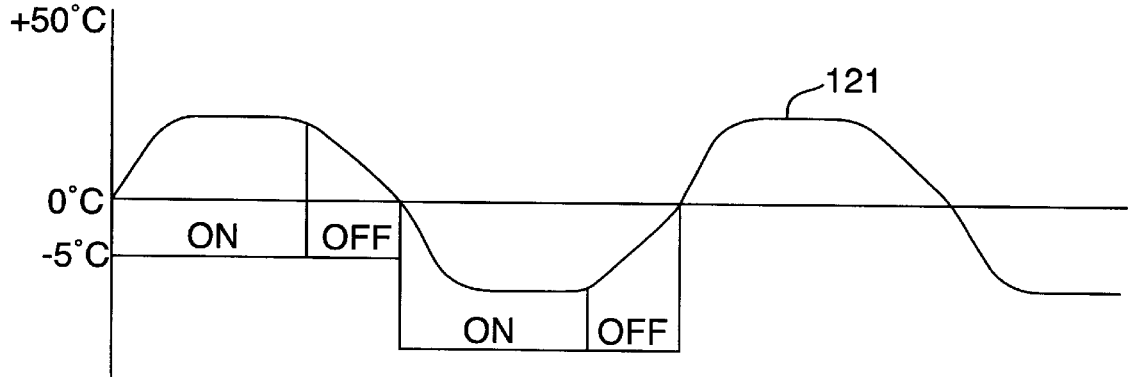
FIG. 5 is a graph showing a temperature variation characteristic of the device of the present invention.

On the other hand, the rush current restricting element 25 connected to the electric source restricts excessive rush current input into the semiconductor heat exchange element 12, thus preventing a sudden temperature variation of the heat exchange element 12 and a reduction of the life span of the heat exchange element 12. The temperature variation characteristic of the fomentation head 1 controlled, as described above is illustrated in FIG. 5.

The temperature sensor 16 and the first and second control circuits 23 and 24 operate the power on-off relay switch 22, thus preventing the cold and hot temperatures of the fomentation head 1 from exceeding a predetermined temperature range.

Figure 2:
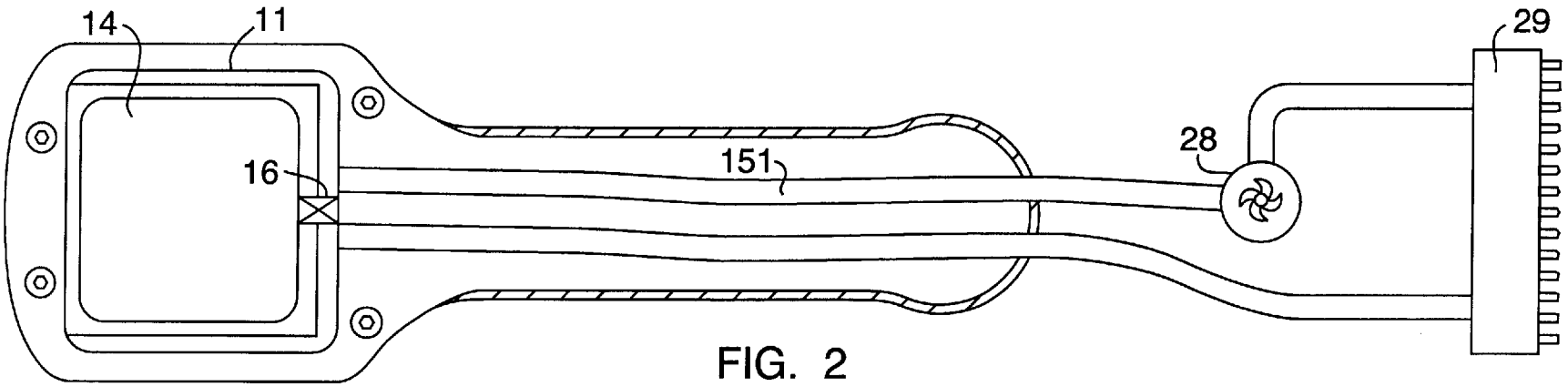
FIG. 2 is a horizontal cross section of the fomentation head of the device of the present invention.
Figure 3:
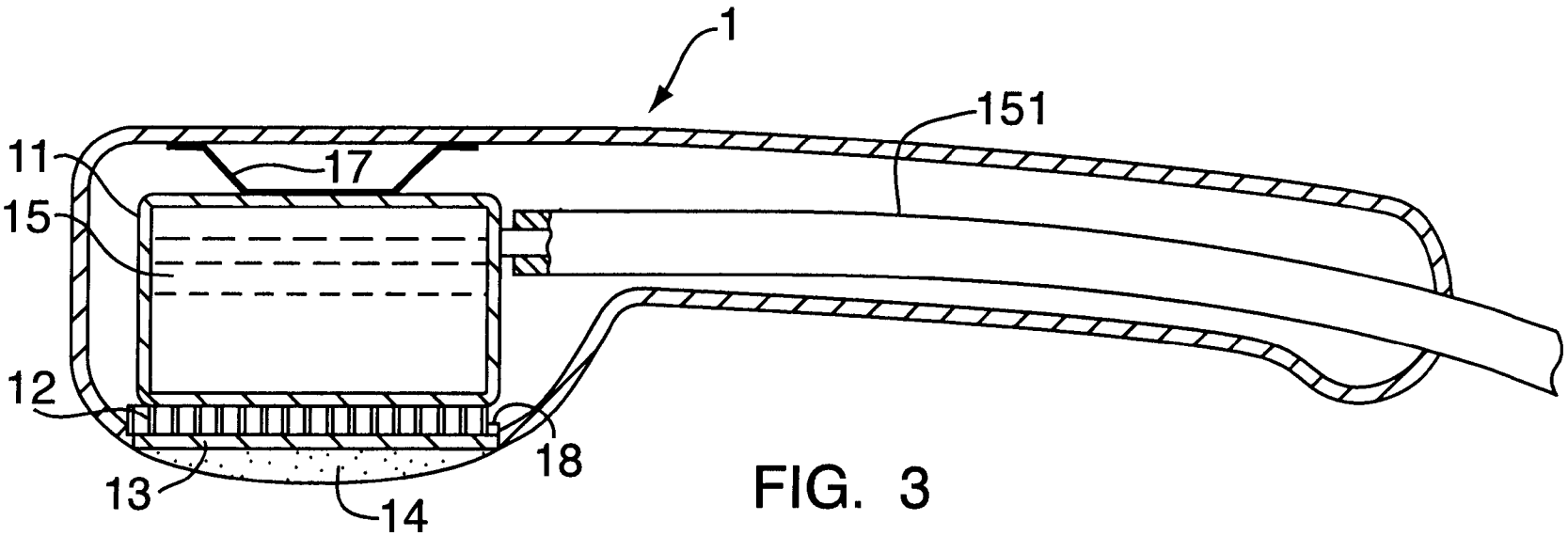
FIG. 3 is a vertical cross section of the fomentation head of the device.
Figure 4:
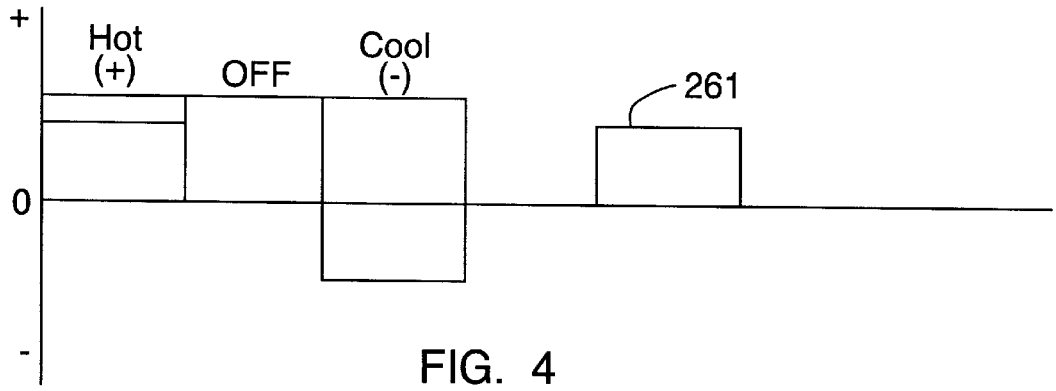
FIG. 4 is a graph showing output signals of a control program circuit.

Referring to FIGS. 2 and 3, an embodiment of the fomentation head 1 is described in the following in brief.

A far infrared radiation ceramic or metal layer 14 is positioned at the bottom of the fomentation head 1. The heat conducting plate 13 is placed on the top surface of the layer 14. The heat exchange element 12 is fixed to the top surface of the heat conducting plate 13. The coolant tank 11 is placed at the top surface of the heat conducting plate 13. In order to provide elasticity to the fomentation head 1, a spring member 17 is interposed between the coolant tank 11 and the upper portion of the head casing.

On the other hand, in order to simplify the construction of the device and provide a practical temperature characteristic, the coolant circulating circuit is constructed by filling the coolant tank 11 with coolant 15, connecting a coolant circulating tube 151 to the coolant tank 11 and interposing the pump 28 and the heat exchange tank 29 at certain portions of the coolant circulating tube 151. As a result, the coolant of 10–20CC per a second may be circulated through the coolant circulating circuit, thereby obtaining a temperature characteristic suitable for the cold and warm fomentations.

As described above, the present invention provides a device for cold and warm fomentations, performing a cold fomentation as well as a warm fomentation, being capable of controlling the temperature of the fomentation head over a wide range of, for example, "+60°C."–"−10°C.", being inexpensively manufactured and being of a small size.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A device for cold and warm fomentations, comprising:

a fomentation head, consisting of,
- a semiconductor heat exchange element,
- a coolant tank mounted on a top surface of the heat exchange element,
- a heat conducting plate fixed to a bottom surface of the heat exchange element, and
- a far infrared radiation ceramic or metal-coated layer positioned on a bottom surface of the heat conducting plate; and a heat exchange element control unit, consisting of,
- a direct current electric source supplying electric power to the heat exchange element,
- a power polarity converting switch circuit connected to the heat exchange element in parallel with the electric source,
- a program circuit connected to the power polarity converting switch circuit at its output terminal, the program circuit outputting control program signals that manually or automatically convert a polarity of the electric power according to predetermined time intervals,
- a rush current restricting element connected to the heat exchange element,
- a power on-off relay switch connected to the program circuit at its input terminal and connected to the power polarity converting switch circuit and the rush current restricting element, and
- a first control circuit and a second control circuit connected to the heat exchange element at their input terminals and to the power on-off relay switch at their output terminals, the first control circuit outputting a switching signal at a predetermined maximum plus degree temperature, while the second control circuit outputs a switching signal at a predetermined maximum minus degree temperature.

2. The device according to claim 1 wherein said heat conducting plate is provided with a temperature sensor.

3. The device according to claim 1, wherein said coolant tank is connected to a coolant circulating tube and a pump and a heat exchange tank is interposed at certain portions of the coolant circulating tube.

* * * * *